US012467107B2

(12) United States Patent
Noh et al.

(10) Patent No.: US 12,467,107 B2
(45) Date of Patent: Nov. 11, 2025

(54) COLD ROLLED STEEL SHEET WITH ULTRA-HIGH STRENGTH, AND MANUFACTURING METHOD THEREFOR

(71) Applicant: Hyundai Steel Company, Incheon (KR)

(72) Inventors: Hyun Seong Noh, Incheon (KR); Nam Hoon Goo, Incheon (KR); Han Sol Maeng, Incheon (KR)

(73) Assignee: Hyundai Steel Company, Incheon (KR)

( * ) Notice: Subject to any disclaimer, the term of this patent is extended or adjusted under 35 U.S.C. 154(b) by 967 days.

(21) Appl. No.: 17/609,587

(22) PCT Filed: May 15, 2020

(86) PCT No.: PCT/KR2020/006387
§ 371 (c)(1),
(2) Date: Nov. 8, 2021

(87) PCT Pub. No.: WO2021/117989
PCT Pub. Date: Jun. 17, 2021

(65) Prior Publication Data

US 2022/0205059 A1 Jun. 30, 2022

(30) Foreign Application Priority Data

Dec. 9, 2019 (KR) ..... 10-2019-0162495

(51) Int. Cl.
*C21D 9/46* (2006.01)
*C21D 1/18* (2006.01)
(Continued)

(52) U.S. Cl.
CPC ..... *C21D 9/46* (2013.01); *C21D 1/18* (2013.01); *C21D 6/005* (2013.01); *C21D 6/008* (2013.01);
(Continued)

(58) Field of Classification Search
None
See application file for complete search history.

(56) References Cited

U.S. PATENT DOCUMENTS

2012/0009434 A1* 1/2012 Hata ..... C22C 38/12 428/577
2014/0342183 A1 11/2014 Wakabayashi et al.
(Continued)

FOREIGN PATENT DOCUMENTS

CN 106164319 A 11/2016
EP 3 080 322 B1 10/2016
(Continued)

OTHER PUBLICATIONS

Office Action issued on Jan. 8, 2024 in corresponding German Patent Application No. 102020006043.8.
(Continued)

*Primary Examiner* — Xiaowei Su
(74) *Attorney, Agent, or Firm* — Fox Rothschild LLP

(57) ABSTRACT

Provided are a cold rolled steel sheet with ultra-high strength, and a manufacturing method therefor. In an exemplary embodiment, a cold rolled steel sheet with ultra-high strength includes an amount of 0.10 to 0.40 wt % of carbon (C), an amount of 0.10 to 0.80 wt % of silicon (Si), an amount of 0.6 to 1.4 wt % of manganese (Mn), an amount of 0.01 to 0.30 wt % of aluminum (Al), an amount greater than 0 and less than or equal to 0.02 wt % of phosphorus (P), an amount greater than 0 and less than or equal to 0.003 wt % of sulfur (S), an amount greater than 0 and less than or equal to 0.006 wt % of nitrogen (N), an amount greater than 0 and less than or equal to 0.05 wt % of titanium (Ti) in, an amount of 0 to 0.05 wt % of niobium (Nb), an amount of 0.001 to 0.003 wt % of boron (B), and the balance of iron (Fe) and other inevitable impurities, wherein the cold rolled steel sheet has a microstructure comprising tempered mar-
(Continued)

tensite and has a 900 bending workability (R/t) of 1.5 or less, and the mass ratio (Nb/Ti) of niobium (Nb) to titanium (Ti) is 1.5 or less.

9 Claims, 4 Drawing Sheets

(51) Int. Cl.

| | |
|---|---|
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/12*** | (2006.01) |
| ***C22C 38/14*** | (2006.01) |

(52) U.S. Cl.
CPC ..... *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/02* (2013.01); *C22C 38/04* (2013.01); *C22C 38/06* (2013.01); *C22C 38/12* (2013.01); *C22C 38/14* (2013.01); *C21D 2211/008* (2013.01)

(56) References Cited

U.S. PATENT DOCUMENTS

| | | | | |
|---|---|---|---|---|
| 2015/0368742 | A1* | 12/2015 | Shibata | C21D 8/0226 148/320 |
| 2016/0304981 | A1* | 10/2016 | Song | C21D 8/0236 |
| 2018/0202016 | A1* | 7/2018 | Yokoyama | C22C 38/02 |
| 2019/0040483 | A1* | 2/2019 | Kimata | C22C 38/48 |

FOREIGN PATENT DOCUMENTS

| | | | |
|---|---|---|---|
| EP | 3 778 949 | A1 | 2/2021 |
| JP | 2010196115 | A | 9/2010 |
| JP | WO 2017-179372 | A1 | 4/2018 |
| JP | 6465256 | B1 | 2/2019 |
| KR | 20100116608 | A | 11/2010 |
| KR | 20120127733 | A | 11/2012 |
| KR | 101607786 | B1 | 3/2016 |
| KR | 20170103905 | A | 9/2017 |
| KR | 20180126721 | A | 11/2018 |

OTHER PUBLICATIONS

Examination Report issued on Aug. 16, 2022 in corresponding Indian Patent Application No. 202217007474.
Office Action issued on Feb. 23, 2022 in corresponding Chinese Application No. CN 202080035856.6.

* cited by examiner

COLD ROLLED STEEL SHEET WITH ULTRA-HIGH STRENGTH, AND MANUFACTURING METHOD THEREFOR

CROSS-REFERENCE TO RELATED APPLICATIONS

This application is a National Phase application filed under 35 USC 371 of PCT International Application No. PCT/KR2020/006387 with an International Filing Date of May 15, 2020, which claims priority from Korean Application 10-2019-0162495 filed on Dec. 9, 2019. The entire contents of these applications are incorporated herein by reference in their entirety.

TECHNICAL FIELD

The present invention relates to an ultra-high-strength cold-rolled steel sheet and a method for manufacturing the same. More particularly, the present invention relates to an ultra-high-strength cold-rolled steel sheet having excellent rigidity, formability, and hydrogen delayed fracture resistance and a method for manufacturing the same.

BACKGROUND

In order to manufacture parts, such as bumper beams, which are directly related to passenger safety in the event of a collision, among vehicle parts, steel having excellent bendability required for formation while having high yield strength and tensile strength is required. In order to satisfy the high tensile strength of steel, ultra-high-strength steel containing some ferrite and bainite in a microstructure based on martensite and tempered martensite has been developed.

In addition, since delayed fracture due to hydrogen penetration may occur in steel having an ultra-high-strength of 150 kgf or greater, it is necessary to develop a material having high delayed fracture resistance in order to apply the material to automotive parts.

The background art related to the present invention is disclosed in Korean Patent Application Publication No. 2012-0127733 (published on Nov. 23, 2012; entitled "Ultra-High-Strength Steel Sheet Having Excellent Workability and Method for Manufacturing the Same").

SUMMARY OF THE INVENTION

Technical Problem

An embodiment of the present invention is intended to provide an ultra-high-strength cold-rolled steel sheet having excellent rigidity, bending workability and hydrogen delayed fracture resistance.

Another embodiment of the present invention is intended to provide an ultra-high-strength cold-rolled steel sheet having excellent surface quality as a result of minimizing the occurrence of inclusions and segregation.

Still another embodiment of the present invention is intended to provide an ultra-high-strength cold-rolled steel sheet having excellent productivity and economic efficiency.

Yet another embodiment of the present invention is intended to provide a method for manufacturing the ultra-high-strength cold-rolled steel sheet.

Technical Solution

An aspect of the present invention is directed to an ultra-high-strength cold-rolled steel sheet. In an exemplary embodiment, the ultra-high-strength cold-rolled steel sheet includes an amount of 0.10 to 0.40 wt % carbon (C), an amount of 0.10 to 0.80 wt % silicon (Si), an amount of 0.6 to 1.4 wt % manganese (Mn), an amount of 0.01 to 0.30 wt % aluminum (Al), an amount greater than 0 and less than or equal to 0.02 wt % phosphorus (P), an amount greater than 0 and less than or equal to 0.003 wt % sulfur (S), an amount greater than 0 and less than or equal to 0.006 wt % nitrogen (N), an amount greater than 0 and less than or equal to 0.05 wt % titanium (Ti), an amount of 0 to 0.05 wt % niobium (Nb), an amount of 0.001 to 0.003 wt % boron (B), and the remainder being iron (Fe) and other inevitable impurities, and has a microstructure including tempered martensite, a 900 bending workability (R/t) of 1.5 or less, and a mass ratio (Nb/Ti) of niobium (Nb) to titanium (Ti) of 1.5 or less.

In an exemplary embodiment, the average grain size of the microstructure may be 6 μm or less.

In an exemplary embodiment, the ultra-high-strength cold-rolled steel sheet may further include more than 0 and less than or equal to 0.2 wt % molybdenum (Mo).

In an exemplary embodiment, the ultra-high-strength cold-rolled steel sheet may have a yield strength (YS) of 1,200 MPa or greater, a tensile strength (TS) of 1,470 MPa or greater, and an elongation (EL) of 5.0% or greater.

In an exemplary embodiment, the ultra-high-strength cold-rolled steel sheet may not fracture for 100 hours or more during a hydrogen delayed fracture test (4-point load test) performed according to ASTM G39-99 standard.

Another aspect of the present invention is directed to a method for manufacturing the ultra-high-strength cold-rolled steel sheet. In an exemplary embodiment, the method for manufacturing the ultra-high-strength cold-rolled steel sheet includes steps of: manufacturing a hot-rolled steel sheet from a steel slab including an amount of 0.10 to 0.40 wt % carbon (C), an amount of 0.10 to 0.80 wt % silicon (Si), an amount of 0.6 to 1.4 wt % manganese (Mn), an amount of 0.01 to 0.30 wt % aluminum (Al), an amount greater than 0 and less than or equal to 0.02 wt % phosphorus (P), an amount greater than 0 and less than or equal to 0.003 wt % sulfur (S), an amount greater than 0 and less than or equal to 0.006 wt % nitrogen (N), an amount greater than 0 and less than or equal to 0.05 wt % titanium (Ti), an amount of 0 to 0.05 wt % niobium (Nb), an amount of 0.001 to 0.003 wt % boron (B), and the remainder being iron (Fe) and other inevitable impurities; manufacturing a cold-rolled steel sheet by cold rolling the hot-rolled steel sheet; subjecting the cold-rolled steel sheet to annealing heat treatment by heating to and holding at a temperature higher than or equal to Ae3; cooling the cold-rolled steel sheet subjected to annealing heat treatment; and tempering the cooled cold-rolled steel sheet, wherein the cooling includes a first cooling step of cooling the cold-rolled steel sheet, subjected to annealing heat treatment, to a temperature of 730 to 820° C. at a cooling rate of 15° C./s or less; and a second cooling step of cooling the cold-rolled steel sheet, subjected to the first cooling step, to a temperature of room temperature to 150° C. at a cooling rate of 80° C./s or greater, and the manufactured cold-rolled steel sheet has a microstructure including tempered martensite, a 900 bending workability (R/t) of 1.5 or less, and a mass ratio (Nb/Ti) of niobium (Nb) to titanium (Ti) of 1.5 or less.

In an exemplary embodiment, the steel slab may further include an amount greater than 0 and less than or equal to 0.2 wt % molybdenum (Mo).

In an exemplary embodiment, the hot-rolled steel sheet may be manufactured by a method including steps of: reheating the steel slab to a temperature of 1,180 to 1,250°

C.; manufacturing a rolled material by hot-rolling the reheated steel slab at a finish delivery temperature of 850 to 950° C.; and cooling the rolled material, followed by coiling at a coiling temperature of 450 to 650° C.

In an exemplary embodiment, in the second cooling step, the cooling rate from 450° C. to 150° C. may be 140° C./s or greater.

In an exemplary embodiment, the tempering may be performed by heating the cold-rolled steel sheet to a temperature of 150 to 250° C., followed by holding for 50 to 500 seconds.

In an exemplary embodiment, the cold-rolled steel sheet may have a yield strength (YS) of 1,200 MPa or greater, a tensile strength (TS) of 1,470 MPa or greater, and an elongation (EL) of 5.0% or greater.

In an exemplary embodiment, the cold-rolled steel sheet may not fracture for 100 hours or more during a hydrogen delayed fracture test (4-point load test) performed according to ASTM G39-99 standard.

Advantageous Effects

The ultra-high-strength cold-rolled steel sheet manufactured by the method for manufacturing an ultra-high-strength cold-rolled steel sheet according to the present invention may have excellent rigidity, bending workability and hydrogen delayed fracture resistance, may have excellent surface quality as a result of minimizing the occurrence of inclusions and segregation, and may have excellent productivity and economic efficiency.

DETAILED DESCRIPTION

Figure 1:
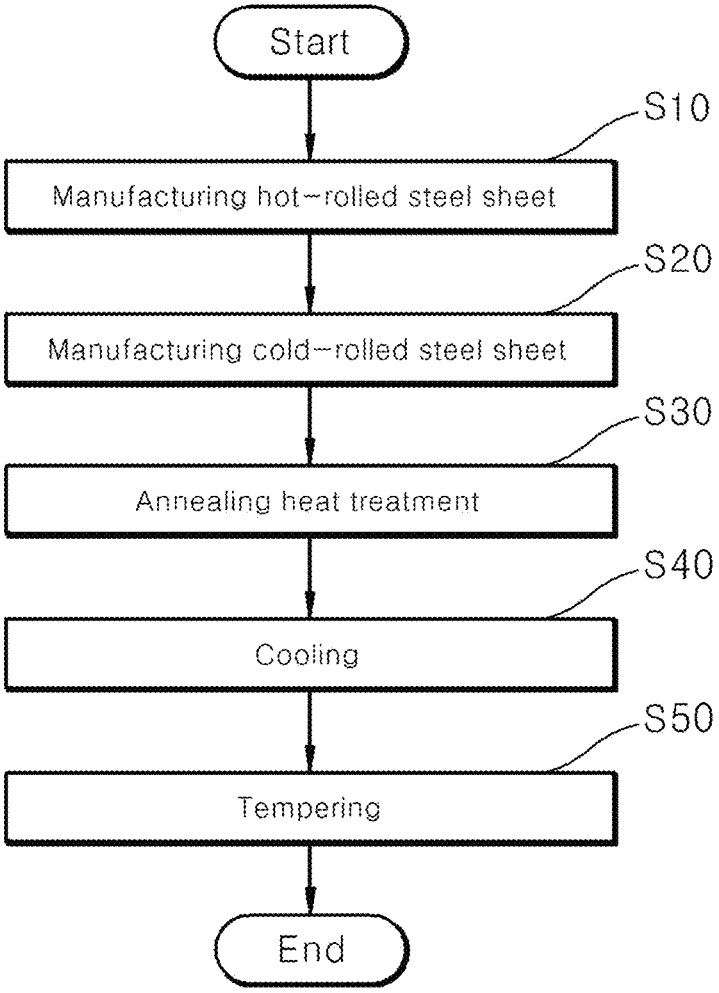
FIG. 1 shows a method for manufacturing an ultra-high-strength cold-rolled steel sheet according to an exemplary embodiment of the present invention.

Hereinafter, the present invention will be described in detail. In the following description, the detailed description of related publicly-known technology or configuration will be omitted when it may unnecessarily obscure the subject matter of the present invention.

In addition, the terms used in the following description are terms defined taking into consideration the functions obtained in accordance with embodiments of the present invention, and may be changed in accordance with the option of a user or operator or a usual practice. Accordingly, the definition of the terms should be made based on the contents throughout the present specification.

Ultra-High-Strength Cold-Rolled Steel Sheet

An aspect of the present invention is directed to an ultra-high-strength cold-rolled steel sheet. In an exemplary embodiment, the ultra-high-strength cold-rolled steel sheet includes an amount of 0.10 to 0.40 wt % carbon (C), an amount of 0.10 to 0.80 wt % silicon (Si), an amount of 0.6 to 1.4 wt % manganese (Mn), an amount of 0.01 to 0.30 wt % aluminum (Al), an amount of greater than 0 and less than or equal to 0.02 wt % phosphorus (P), an amount greater than 0 and less than or equal to 0.003 wt % sulfur (S), an amount greater than 0 and less than or equal to 0.006 wt % nitrogen (N), an amount greater than 0 and less than or equal to 0.05 wt % titanium (Ti), an amount of 0 to 0.05 wt % niobium (Nb), an amount of 0.001 to 0.003 wt % boron (B), and the remainder being iron (Fe) and other inevitable impurities, and has a microstructure including tempered martensite, a 900 bending workability (R/t) of 1.5 or less, and a mass ratio (Nb/Ti) of niobium (Nb) to titanium (Ti) of 1.5 or less.

Hereinafter, the role and content of each component contained in the ultra-high-strength cold-rolled steel sheet of the present invention will be described in detail.

Carbon (C)

The carbon (C) is added to secure the strength of the steel, and the strength increases as the carbon content in the martensitic structure increases. In an exemplary embodiment, the carbon is included in an amount of 0.10 to 0.40 wt % based on the total weight of the cold-rolled steel sheet. If the carbon is included in an amount of less than 0.10 wt %, it may be difficult to obtain a target strength, and if the carbon is included in an amount of more than 0.40 wt %, there may be disadvantages in weldability, bendability and the like. Preferably, the carbon may be included in an amount of 0.20 to 0.26 wt %.

Silicon (Si)

The silicon (Si), a ferrite stabilizing element, delays the formation of carbides in ferrite and has a solid solution strengthening effect. In an exemplary embodiment, the silicon is included in an amount of 0.10 to 0.80 wt % based on the total weight of the cold-rolled steel sheet. If the silicon is included in an amount of less than 0.10 wt %, the effect thereof may be very small, and if the silicon is included in an amount of more than 0.80 wt %, it may reduce plating properties by forming an oxide such as $Mn_2SiO_4$ in the manufacturing process, and reduce weldability by increasing carbon equivalent. Preferably, the silicon may be included in an amount of 0.10 to 0.50 wt %.

Manganese (Mn)

The manganese (Mn) has a solid solution strengthening effect and contributes to strength improvement by increasing hardenability. In an exemplary embodiment, the manganese is included in an amount of 0.6 to 1.4 wt % based on the total weight of the cold-rolled steel sheet. If the manganese is included in an amount of less than 0.6 wt %, the effect thereof may not be sufficient, and thus it may be difficult to secure strength, and if the manganese is included in an amount of more than 1.4 wt %, it may reduce the workability and delayed fracture resistance of the steel sheet due to the formation of inclusions such as MnS or segregation, and reduce the weldability of the steel sheet by increasing carbon equivalent.

Aluminum (Al)

The aluminum (Al) is used as a deoxidizer and may help to purify ferrite. In an exemplary embodiment, the aluminum is included in an amount of 0.01 to 0.30 wt % based on the total weight of the cold-rolled steel sheet. If the aluminum is included in an amount of less than 0.01 wt %, the effect thereof may be insufficient, and if the aluminum is included in an amount of more than 0.30 wt %, it may form AlN during slab manufacturing, causing cracks during casting or hot rolling.

Phosphorus (P)

The phosphorus (P) is an impurity incorporated during steelmaking. The phosphorus is included in an amount greater than 0 and less than or equal to 0.02 wt % based on the total weight of the cold-rolled steel sheet. When the phosphorus is added, it can help to enhance strength by solid solution strengthening, but if the phosphorus is included in an amount greater than 0.02 wt %, low-temperature brittleness may occur.

Sulfur (S)

The sulfur (S) is an impurity incorporated during steelmaking. In an exemplary embodiment, the sulfur is included in an amount greater than 0 and less than or equal to 0.003 wt % based on the total weight of the cold-rolled steel sheet. Sulfur reduces toughness and weldability by forming non-metallic inclusions such as FeS and MnS, and thus the content thereof is limited to 0.003 wt % or less. If the sulfur is included in an amount greater than 0.003 wt %, the amount of non-metallic inclusions formed may increase, thereby reducing toughness and weldability.

Nitrogen (N)

When the nitrogen (N) is excessively present in the steel, a large amount of nitride may be precipitated, which may degrade ductility. In an exemplary embodiment, the nitrogen (N) is included in an amount of 0.006 wt % or less based on the total weight of the cold-rolled steel sheet. If the nitrogen is included in an amount greater than 0.006 wt %, the ductility of the cold-rolled steel sheet may be reduced.

Titanium (Ti)

The titanium (Ti), a precipitate-forming element, has the effects precipitating TiN and refining grains. In particular, it is possible to reduce the nitrogen content in the steel through the precipitation of TiN, and when the titanium is added together with boron, it is possible to prevent the precipitation of BN. In an exemplary embodiment, the titanium is included in an amount of more than 0 and less than or equal to 0.05 wt % based on the total weight of the cold-rolled steel sheet. If the titanium is included in an amount greater than 0.05 wt %, it increases the manufacturing cost of the steel. For example, the titanium may be included in an amount of 0.01 to 0.05 wt %.

Niobium (Nb)

The niobium (Nb), a precipitate-forming element, improves the toughness and strength of the steel through precipitation and grain refinement. In an exemplary embodiment, the niobium is included in an amount of 0 to 0.05 wt % based on the total weight of the cold-rolled steel sheet. If the niobium is included in an amount greater than 0.05 wt %, it may greatly increase the rolling load during rolling, and increases the manufacturing cost of the steel.

Boron (B)

The boron (B), a hardenable element, greatly contributes to the formation of martensite after cooling following annealing. In an exemplary embodiment, the boron is included in an amount of 0.001 to 0.003 wt % based on the total weight of the cold-rolled steel sheet. If the boron is included in an amount of less than 0.001 wt %, the effect thereof may be insufficient, making it difficult to ensure martensite, and if the boron is included in an amount of more than 0.003 wt %, it may reduce the toughness of the steel.

In an exemplary embodiment of the present invention, the cold-rolled steel sheet may further include more than 0 and less than or equal to 0.2 wt % molybdenum (Mo).

Molybdenum (Mo)

The molybdenum (Mo) has a solid solution strengthening effect and contributes to strength improvement by increasing hardenability. In an exemplary embodiment, the molybdenum may be included in an amount greater than 0 and less than or equal to 0.20 wt % based on the total weight of the cold-rolled steel sheet. If the molybdenum is included in an amount of more than 0.20 wt %, it increases the manufacturing cost of the steel.

The cold-rolled steel sheet has a microstructure including tempered martensite. For example, the microstructure of the cold-rolled steel sheet may include 95 area % of tempered martensite, with the remainder being at least one of ferrite, bainite, and retained austenite.

Preferably, the microstructure of the cold-rolled steel sheet may consist only of tempered martensite, so that it is possible to ensure a steel sheet having both excellent strength and formability.

In an exemplary embodiment, the average grain size of the microstructure of the cold-rolled steel sheet may be 6 μm or less.

In an exemplary embodiment, the mass ratio (Nb/Ti) of niobium (Nb) to titanium (Ti) is 1.5 or less. In the above mass ratio condition, the grain refinement effect may be excellent, and it is possible to prevent excessive formation of precipitates. If the mass ratio is greater than 1.5, the precipitation strengthening effect and the grain refining effect may be reduced, and thus it may be difficult to secure the grain size and mechanical properties targeted by the present invention. For example, the mass ratio may be 1.3 or less.

In an exemplary embodiment, the cold-rolled steel sheet may have a 900 bending workability (R/t) of 1.5 or less. For example, the 90° bending workability (R/t) may be 1.0 or less.

In an exemplary embodiment, the cold-rolled steel sheet may have a yield strength (YS) of 1,200 MPa or greater, a tensile strength (TS) of 1,470 MPa or greater, and an elongation (EL) of 5.0% or greater. For example, the cold-rolled steel sheet may have a yield strength of 1,200 to 1,500 MPa, a tensile strength of 1,470 to 1,800 MPa, and an elongation of 5.0 to 9.0%.

The cold-rolled steel sheet may not fracture for 100 hours or more during a hydrogen delayed fracture test (4-point load test) performed according to ASTM G39-99 standard.

The titanium (Ti) and niobium (Nb), which are precipitate-forming elements, have a precipitation strengthening effect and a strengthening effect by grain refinement. However, if excessive amounts of precipitates are formed, problems arise in that the ductility of the steel sheet is reduced, resulting in an increase in the rolling load, and coil fracture occurs during cold rolling.

Therefore, in the present invention, the average grain size of the cold-rolled steel sheet is controlled to 6 μm or less not only by controlling the contents of titanium (Ti) and niobium (Nb), but also by controlling the mass ratio (Nb/Ti) of niobium (Nb) to titanium (Ti) to 1.5 or less, preferably 1.3 or less, thereby the precipitation strengthening effect. Thereby, it is possible to secure a tensile strength of 1,470 to 1,800 MPa, a yield strength of 1,200 to 1,500 MPa, and an elongation of 5.0 to 9.0%.

The microstructure of the cold-rolled steel sheet of the present invention, which has the above-described alloying components, may contain at least one of titanium (Ti)-based precipitates and niobium (Nb)-based precipitates. The precipitate may be a titanium (Ti)-based carbide or a niobium (Nb)-based carbide, preferably TiC or NbC. The ratio of precipitates each having a size of 100 nm or less among the precipitates present in the unit area (1 $\mu m^2$=1 m×1 μm) at any point of the cold-rolled steel sheet to precipitates each having a size of more than 100 nm among the precipitates may be 4:1 or greater, preferably 9:1 or greater. If the ratio is less than the above ratio, grain refinement may be insufficient and the strength of the steel sheet may be reduced.

In addition, the number of the precipitates each having a size of 100 nm or less present in the unit area may be 20 to 200, preferably 50 to 100. If the number of the precipitates each having a size of 100 nm or less is larger than the upper limit of the above range, the carbon content in the retained austenite in the final microstructure may decrease, so that the strength and elongation of the steel sheet may decrease due to suppression of the TRIP effect. If the number of the precipitates is less than the lower limit, grain refinement during annealing may be insufficient.

Of course, the high-strength steel sheet of the present invention, which has the above-described alloying components, has have a microstructure in which the number of precipitates each having a size of 100 nm or less is 20 to 200, preferably 50 to 100, while the ratio between the precipitates in the above-described unit area is 4:1 to 9:1 or more.

The ratio between the precipitates and the number of the precipitates may be controlled by applying the above-described alloying component conditions, annealing a cold-rolled steel sheet, which has a mass ratio (Nb/Ti) of niobium (Nb) to titanium (Ti) of 1.5 or less, preferably 1.3 or less, at a temperature higher than or equal to $Ae_3$, preferably 840 to 920° C. for 30 to 120 seconds, and cooling the annealed cold-rolled steel sheet to a temperature of 730 to 820° C. at a rate of 15° C./s or less, preferably cooling from the annealing termination temperature to a temperature of 760 to 810° C. at a rate of 3 to 15° C./s.

Method for Manufacturing Ultra-High-Strength Cold-Rolled Steel Sheet

Another aspect of the present invention is directed to a method for manufacturing the ultra-high-strength cold-rolled steel sheet.

FIG. 1 shows a method for manufacturing an ultra-high-strength cold-rolled steel sheet according to an exemplary embodiment of the present invention. Referring to FIG. 1, the method for manufacturing the ultra-high-strength cold-rolled steel sheet includes steps of: (S10) manufacturing a hot-rolled steel sheet; (S20) manufacturing a cold-rolled steel sheet; (S30) annealing heat treatment; (S40) cooling; and (S50) tempering.

More specifically, the method for manufacturing the ultra-high-strength cold-rolled steel sheet includes steps of: (S10) manufacturing a hot-rolled steel sheet from a steel slab including an amount of 0.10 to 0.40 wt % carbon (C), an amount of 0.10 to 0.80 wt % silicon (Si), an amount of 0.6 to 1.4 wt % manganese (Mn), an amount of 0.01 to 0.30 wt % aluminum (Al), an amount greater than 0 and less than or equal to 0.02 wt % phosphorus (P), an amount greater than 0 and less than or equal to 0.003 wt % sulfur (S), an amount greater than 0 and less than or equal to 0.006 wt % nitrogen (N), an amount greater than 0 and less than or equal to 0.05 wt % titanium (Ti), an amount greater than 0 and less than or equal to 0.05 wt % niobium (Nb), an amount of 0.001 to 0.003 wt % boron (B), and the remainder being iron (Fe) and other inevitable impurities; (S20) manufacturing a cold-rolled steel sheet by cold rolling the hot-rolled steel sheet; (S30) subjecting the cold-rolled steel sheet to annealing heat treatment by heating to and holding at a temperature higher than or equal to $Ae_3$; (S40) cooling the cold-rolled steel sheet subjected to annealing heat treatment; and (S50) tempering the cooled cold-rolled steel sheet, wherein the cooling includes a first cooling step of cooling the cold-rolled steel sheet, subjected to annealing heat treatment, to a temperature of 730 to 820° C. at a cooling rate of 15° C./s or less; and a second cooling step of cooling the cold-rolled steel sheet, subjected to the first cooling step, to a temperature of room temperature to 150° C. at a cooling rate of 80° C./s or greater.

The manufactured cold-rolled steel sheet has a microstructure including tempered martensite, a 900 bending workability (R/t) of 1.5 or less, and a mass ratio (Nb/Ti) of niobium (Nb) to titanium (Ti) of 1.5 or less.

Hereinafter, each step of the method for manufacturing an ultra-high-strength cold-rolled steel sheet according to the present invention will be described in detail.

(S10) Step of Manufacturing Hot-Rolled Steel Sheet

This step is a step of manufacturing a hot-rolled steel sheet from a steel slab including an amount of 0.10 to 0.40 wt % carbon (C), an amount of 0.10 to 0.80 wt % silicon (Si), an amount of 0.6 to 1.4 wt % manganese (Mn), an amount of 0.01 to 0.30 wt % aluminum (Al), an amount greater than 0 and less than or equal to 0.02 wt % phosphorus (P), an amount greater than 0 and less than or equal to 0.003 wt % sulfur (S), an amount greater than 0 and less than or equal to 0.006 wt % nitrogen (N), an amount greater than 0 and less than or equal to 0.05 wt % titanium (Ti), an amount greater than 0 and less than or equal to 0.05 wt % niobium (Nb), an amount of 0.001 to 0.003 wt % boron (B), and the remainder being iron (Fe) and other inevitable impurities.

In an exemplary embodiment, the steel slab has a mass ratio (Nb/Ti) of niobium (Nb) to titanium (Ti) of 1.5 or less.

In an exemplary embodiment, the steel slab may further include an amount greater than 0 and less than or equal to 0.2 wt % molybdenum (Mo).

The components and contents thereof contained in the steel slab are the same as those described above, and thus detailed description thereof will be omitted.

In an exemplary embodiment, the hot-rolled steel sheet may be manufactured by a method including steps of: reheating the steel slab to a temperature of 1,180 to 1,250° C.; manufacturing a rolled material by hot-rolling the reheated steel slab at a finish delivery temperature of 850 to 950° C.; and cooling the rolled material, followed by coiling at a coiling temperature of 450 to 650° C.

In an exemplary embodiment, the steel slab may be manufactured in the form of a semi-finished product by continuously casting molten steel obtained through a steel-making process. In addition, through the reheating process, the steel slab may be manufactured in a state in which component segregation generated in the casting process may be homogenized and the steel slab may be hot rolled.

In an exemplary embodiment, the steel slab may be reheated to a slab reheating temperature (SRT) of 1,180 to 1,250° C. If the slab reheating temperature is below 1,180° C., segregation of the steel slab may not be sufficiently re-dissolved, and if the slab reheating temperature is above 1,250° C., the size of austenite grains may increase, and the process cost may increase. In an exemplary embodiment, the reheating of the steel slab may be performed for 1 to 4 hours. If the reheating time is shorter than 1 hour, reduction in segregation may not be sufficient, and if the reheating time is longer than 4 hours, the grain size may increase and the process cost may increase.

In an exemplary embodiment, the reheated steel slab may be hot-rolled at a finish delivery temperature (FDT) of 850 to 950° C. to manufacture a rolled material. If the hot rolling is performed at a finish delivery temperature less than 850° C., the rolling load may increase rapidly, resulting in a decrease in productivity, and if the finish delivery temperature is higher than 950° C., the grain size may increase and the strength of the steel sheet may decrease.

If the coiling is performed at a coiling temperature less than 450° C., the strength of the steel sheet may increase and the rolling load during cold rolling may increase, and if the coiling is performed at a coiling temperature higher than 650° C., defects may occur in a subsequent process due to surface oxidation or the like.

(S20) Step of Manufacturing Cold-Rolled Steel Sheet

This step is a step of manufacturing a cold-rolled steel sheet by cold-rolling the hot-rolled steel sheet. In an exemplary embodiment, the coiled hot-rolled steel sheet is uncoiled and pickled to remove a surface scale layer, and then cold rolling is performed. For example, the cold rolling may be performed at a thickness reduction ratio of about 40 to 70%.

(S30) Annealing Heat-Treatment Step

This step is a step of subjecting the cold-rolled steel sheet to annealing heat treatment by heating to and holding at a temperature of $Ae_3$ or higher.

In the microstructure of the cold-rolled sheet material subjected to annealing heat treatment under the above conditions, an austenite single-phase structure may be formed.

The annealing heat treatment process affects the grain size of austenite, and the grain size acts as an important factor because it is related to the strength of the steel sheet.

Figure 2:
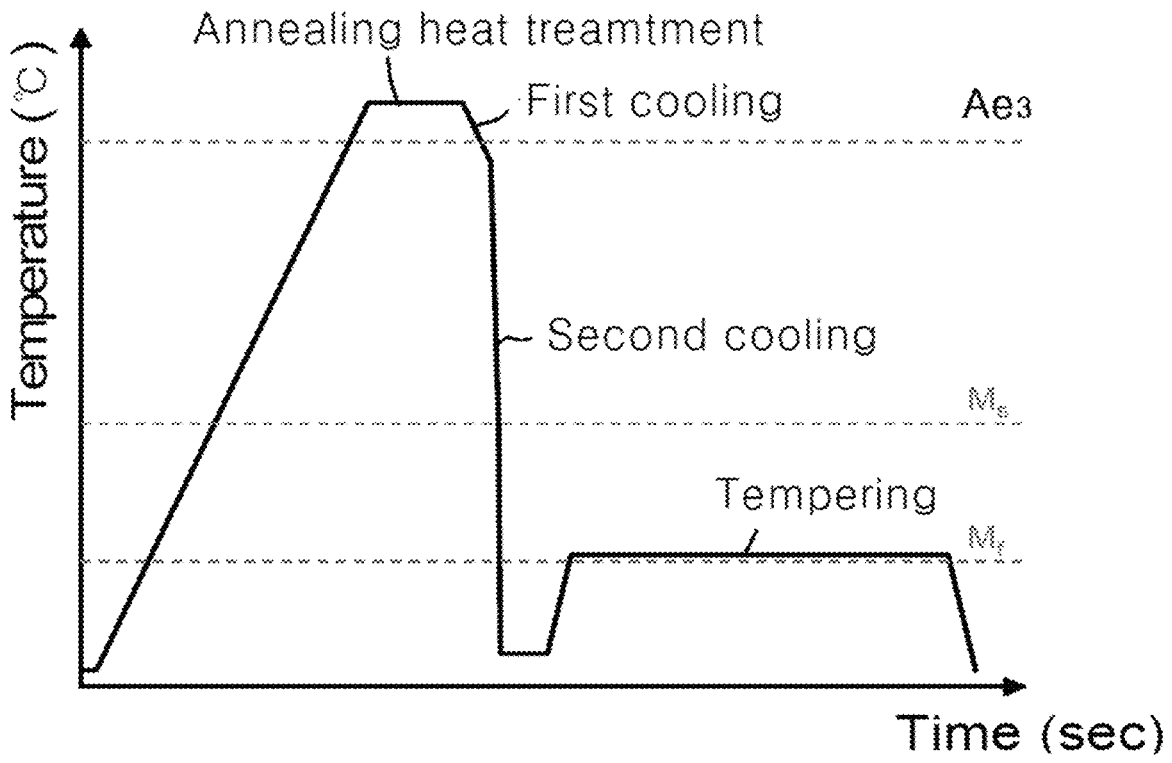
FIG. 2 is a graph showing a heat treatment schedule for a cold-rolled sheet material according to an exemplary embodiment of the present invention.

FIG. 2 is a graph showing a heat treatment schedule for a cold-rolled sheet material according to an exemplary embodiment of the present invention.

Referring to FIG. 2, the cold-rolled steel sheet should be heated to an annealing temperature of $Ae_3$ or higher in order to form an austenite single phase. For the component range of the present invention, an annealing temperature of 840° C. or higher is suitable. For example, the annealing heat treatment may be performed by heating the cold-rolled steel sheet to a temperature of 840 to 920° C. and holding the steel sheet at this temperature for 30 to 120 seconds.

If the annealing heat treatment is performed at a heating temperature less than 840° C. or performed for a heating holding time shorter than 30 seconds, the austenite may not be sufficiently homogenized, and if the annealing heat treatment is performed at a heating temperature higher than 920° C. or performed for a heating holding time longer than 120 seconds, the heat treatment efficiency may be reduced, the austenite grain size may be coarsened, and productivity may be reduced.

In an exemplary embodiment, the heating rate may be 3° C./sec or greater. If the heating rate is less than 3° C./s, it takes too much time to reach the annealing temperature, so that the heat treatment efficiency may be reduced, the austenite grain size may be coarsened, and productivity may be reduced.

(S40) Cooling Step

This step is a step of cooling the cold-rolled steel sheet subjected to annealing heat treatment. In an exemplary embodiment, the cooling includes: a first cooling step of cooling the cold-rolled steel sheet, subjected to annealing heat treatment, to a temperature of 730 to 820° C. at a cooling rate of 15° C./s or less; and a second cooling step of cooling the cold-rolled steel sheet, subjected to the first cooling step, to a temperature of room temperature to 150° C. at a cooling rate of 80° C./s or greater.

Referring to FIG. 2, the first cooling is a slow cooling zone in which cooling is performed at a cooling rate of 15° C./s or less. For example, the cold-rolled steel sheet may be cooled to a temperature of 730 to 820° C. at a cooling rate of 3 to 15° C./s. When cooling in the first cooling zone is performed, ferrite transformation of the cold-rolled steel sheet may be suppressed, and the difference in temperature between the first cooling zone and the second cooling zone may be reduced. If the first cooling is terminated at a temperature less than 730° C., ferrite transformation may occur during the first cooling, causing a decrease in the strength of the steel sheet.

The second cooling is a rapid cooling zone in which cooling is performed at a cooling rate of 80° C./s or greater. The second cooling zone may suppress the phase transformation of ferrite and bainite through rapid cooling, cause martensite transformation, and suppress tempering during cooling. If the second cooling is performed at a cooling rate less than 80° C./s, it may cause a decrease in strength due to the phase transformation of ferrite or bainite.

Referring to FIG. 2, in the second cooling, the steel sheet may be cooled to the Ms temperature or higher at a cooling rate of 80° C./s or greater, and then cooled to the Mf temperature or less at a cooling rate of 140° C./s or greater. In an exemplary embodiment, in the second cooling, the steel sheet may be cooled to a temperature of 400 to 450° C. at a cooling rate of 80° C./s or greater, and then cooled to a temperature of room temperature to 150° C. at a cooling rate of 140° C./s or greater.

The second cooling is preferably performed at a cooling rate of 140° C./s or greater in a temperature range from 450° C. to 150° C. When rapid cooling is performed at a cooling rate of 140° C./s or greater in the above temperature range, it is possible to ensure a tempered martensite fraction of 95% or greater by minimizing the formation of microstructures such as ferrite, bainite or retained austenite, and preferably, it is possible to obtain a microstructure consisting only of tempered martensite.

(S50) Tempering Step

This step is a step of tempering the cooled cold-rolled steel sheet. In an exemplary embodiment, the tempering may be performed by heating the cold-rolled steel sheet to a temperature of 150 to 250° C. and holding the steel sheet at this temperature for 50 to 500 seconds. Under the above conditions, the tempered martensite microstructure of the cold-rolled sheet material according to the present invention may be easily formed. If the cold-rolled steel sheet is tempered by heating to a temperature lower than 150° C., the tempering effect may be insignificant, and if the cold-rolled steel sheet is tempered by heating to a temperature higher than 250° C., the size of carbides may be coarsened, causing a decrease in the strength of the steel sheet.

In an exemplary embodiment, tempering may be performed by reheating immediately after the above-described secondary cooling process, or tempering may be performed after the cold-rolled steel sheet is held at room temperature for several minutes or more after the second cooling process.

In an exemplary embodiment, the average grain size of the microstructure of the cold-rolled steel sheet may be 6 μm or less.

In an exemplary embodiment, the cold-rolled steel sheet may have a yield strength (YS) of 1,200 MPa or greater, a tensile strength (TS) of 1,470 MPa or greater, and an elongation (EL) of 5.0% or greater.

In an exemplary embodiment, the cold-rolled steel sheet may not fracture for 100 hours or more in a hydrogen delayed fracture test (4-point load test) performed according to ASTM G39-99 standard.

Although the present invention describes a method for manufacturing high-strength steel using martensite, similar to conventional arts, it differs in that 1) it is possible to reduce disadvantages caused by inclusions such as MnS or segregation by reducing the content of manganese (Mn), and 2) it is possible to suppress tempering during cooling through first and second rapid cooling processes after slow cooling, and then obtain homogeneous tempered martensite through tempering. In addition, the present invention has an advantage in that the amount of ferroalloy added during steelmaking is small because the manganese content is less than that in the alloy composition of a conventional art.

In addition, the cold-rolled steel sheet of the present invention may be applied to automotive parts, and may have a 900 bending workability (R/t) of 1.5 or less and excellent delayed fracture resistance while having a high yield strength of 1,200 MPa or greater and a high tensile strength of 1,500 MPa or greater.

The entire microstructure of the cold-rolled steel sheet includes tempered martensite, and the present invention describes the sufficient amounts of carbon and alloying elements added to secure bending workability and tensile strength, and describes cold-rolled heat treatment conditions suitable therefor. In addition, in order to prevent an increase in the cost of ferroalloy and to secure resistance to hydrogen embrittlement, the present invention imposes restrictions on suitable alloying components.

In order to secure the bending formability of a cold-rolled steel sheet in a conventional art, a structure was realized through a process of: forming an austenite single-phase structure by subjecting the steel sheet to annealing heat treatment through heating to a temperature higher than or equal to the $Ae_3$ temperature and holding at this temperature during a cold-rolling heat treatment process; rapidly cooling the steel sheet to a temperature lower than or equal to the Ms point at a rate of 50° C./s or less after the annealing heat treatment, thereby suppressing phase transformation into soft structures such as ferrite and inducing transformation into a martensitic microstructure; and tempering the steel sheet after the rapid cooling, thereby completing the tempering of martensite and the transformation of a retained austenite microstructure into martensite during cooling.

However, if a cooling rate of 50° C./s or less is applied during the rapid cooling as in the conventional art, phase transformation into soft structures such as ferrite could be suppressed only when alloying components such as manganese (Mn), chromium (Cr) and molybdenum (Mo) were sufficiently added. The addition of the alloying components could cause an increase in the production cost, and when the content of manganese (Mn) increased, the formability or the like of the steel sheet could deteriorate due to the formation of a band structure. In addition, at the cooling rate described above, a problem arose in that martensite formed at a temperature near the Ms temperature is tempered during cooling for several seconds, and a structure with large carbides is formed, which has a less yield strength than tempered martensite having fine carbides formed therein.

EXAMPLE

Hereinafter, the configurations and operations of the present invention will be described in more detail with reference to preferred examples of the present invention. However, the following examples are provided to help understand the present invention, and the scope of the present invention is not limited to the following examples.

Preparation Examples 1 to 10

According to the components and contents shown in Table 1 below, steel slabs were prepared which each included alloying components, more than 0 and less than or equal to 0.006 wt % nitrogen (N), and the balance of iron (Fe) and other inevitable impurities. In addition, Table 1 below also shows the alloy critical temperatures (Ae3 transformation temperature, martensite transformation start temperature (Ms), and the transformation temperature (M90) at which a martensitic volume fraction of 9000 is reached) calculated by JMATPRO for the alloy systems of Preparation Examples 1 to 10.

TABLE 1

| | Components (wt %) | | | | | | | | | | Critical temperatures (° C.) | | |
|---|---|---|---|---|---|---|---|---|---|---|---|---|---|
| | C | Si | Mn | P | S | Al | Mo | Nb | Ti | B | $Ae_3$ | Ms | M90% |
| Prep. Ex. 1 | 0.203 | 0.182 | 1.18 | 0.02 | 0.0011 | 0.014 | — | 0.019 | 0.038 | 0.0014 | 830 | 405 | 294 |
| Prep. Ex. 2 | 0.223 | 0.204 | 1.21 | 0.02 | 0.0012 | 0.012 | — | — | 0.048 | 0.0019 | 815 | 395 | 287 |
| Prep. Ex. 3 | 0.25 | 0.2 | 0.98 | 0.01 | 0.0012 | 0.037 | — | — | 0.043 | 0.0021 | 815 | 397 | 286 |
| Prep. Ex. 4 | 0.235 | 0.32 | 1.01 | 0.014 | 0.0035 | 0.022 | — | — | 0.038 | 0.002 | 820 | 398 | 287 |
| Prep. Ex. 5 | 0.231 | 0.203 | 0.81 | 0.014 | 0.0021 | 0.024 | 0.05 | — | 0.043 | 0.0025 | 825 | 410 | 301 |
| Prep. Ex. 6 | 0.179 | 0.192 | 1.35 | 0.018 | 0.0024 | 0.031 | — | — | 0.034 | 0.0029 | 823 | 405 | 295 |
| Prep. Ex. 7 | 0.207 | 0.206 | 1.56 | 0.011 | 0.0014 | 0.017 | — | — | 0.048 | 0.0017 | 810 | 391 | 279 |
| Prep. Ex. 8 | 0.277 | 0.241 | 0.94 | 0.014 | 0.0012 | 0.045 | — | 0.028 | 0.051 | 0.0028 | 814 | 390 | 279 |
| Prep. Ex. 9 | 0.228 | 0.188 | 0.42 | 0.014 | 0.0014 | 0.011 | — | — | 0.027 | 0.0018 | 833 | 428 | 321 |
| Prep. Ex. 10 | 0.261 | 0.12 | 1.37 | 0.02 | 0.0028 | 0.013 | — | 0.018 | 0.005 | 0.0013 | 800 | 378 | 265 |

Examples 1 to 15 and Comparative Examples 1 to 9

Cold-rolled steel sheets were manufactured from the steel slabs prepared in Preparation Examples 1 to 9 above. Specifically, each of the steel slabs shown in Table 2 below was reheated to 1,220° C., and each of the reheated steel slabs was hot-rolled to a thickness of 3.2 mm at a finish delivery temperature of 900° C. to manufacture rolled materials, and then each of the rolled materials was cooled, coiled at a coiling temperature of 600° C., thus manufacturing hot-rolled steel sheets. Then, each of the hot-rolled steel sheets was pickled to remove a surface oxide layer, and cold-rolled to a thickness of 1.2 mm to manufacture cold-rolled steel sheets. The cold-rolled steel sheets were subjected to annealing heat treatment by heating and holding under the conditions shown in Table 2 below, and then cooled and tempered, thus manufacturing cold-rolled steel sheets. The above cooling was performed through a first cooling step in which each of the cold-rolled steel sheets was cooled under the cooling rate and cooling termination temperature conditions shown in Table 2 below, and then a second cooling step in which each cold-rolled steel sheet subjected to the first cooling step was cooled to the cooling temperature zone (1) (ranging from 400° C. to lower than 450° C.) under a condition of the cooling rate (1) shown in Table 2 below, and then cooled to the cooling temperature zone (2) (ranging from room temperature to 150° C.) at the cooling rate (2) shown in Table 2 below.

TABLE 2

| | | Annealing heat treatment | | First cooling | | Second cooling | | Tempering | |
|---|---|---|---|---|---|---|---|---|---|
| | Steel slab | Annealing temp. (° C.) | Holding time (s) | Rate (° C./s) | Termination temp. (° C.) | Cooling rate (1) (° C./s) | Cooling rate (2) (° C./s) | Temp. (° C.) | Holding time (s) |
| Ex. 1 | Prep. Ex. 1 | 900 | 60 | 5 | 800 | 600 | 300 | 200 | 240 |
| Ex. 2 | Prep. Ex. 1 | 900 | 60 | 5 | 800 | 600 | 300 | 160 | 60 |
| Ex. 3 | Prep. Ex. 1 | 900 | 60 | 5 | 800 | 600 | 300 | 160 | 240 |
| Ex. 4 | Prep. Ex. 2 | 900 | 60 | 5 | 800 | 600 | 300 | 200 | 240 |
| Ex. 5 | Prep. Ex. 2 | 900 | 60 | 5 | 800 | 600 | 300 | 200 | 120 |
| Ex. 6 | Prep. Ex. 2 | 900 | 60 | 5 | 800 | 480 | 150 | 200 | 240 |
| Ex. 7 | Prep. Ex. 2 | 890 | 60 | 5 | 750 | 480 | 150 | 200 | 240 |
| Ex. 8 | Prep. Ex. 3 | 900 | 60 | 5 | 800 | 480 | 150 | 200 | 240 |
| Ex. 9 | Prep. Ex. 3 | 900 | 60 | 5 | 800 | 480 | 150 | 160 | 480 |
| Ex. 10 | Prep. Ex. 3 | 900 | 60 | 5 | 800 | 480 | 150 | 200 | 480 |
| Ex. 11 | Prep. Ex. 3 | 900 | 60 | 5 | 800 | 480 | 150 | 200 | 480 |
| Ex. 12 | Prep. Ex. 3 | 870 | 60 | 5 | 800 | 480 | 150 | 200 | 240 |
| Ex. 13 | Prep. Ex. 3 | 850 | 60 | 5 | 800 | 480 | 150 | 200 | 240 |
| Ex. 14 | Prep. Ex. 4 | 900 | 60 | 5 | 800 | 480 | 150 | 200 | 240 |
| Ex. 15 | Prep. Ex. 5 | 900 | 60 | 5 | 800 | 480 | 150 | 200 | 240 |
| Comp. Ex. 1 | Prep. Ex. 1 | 890 | 60 | 5 | 800 | 600 | 300 | — | — |
| Comp. Ex. 2 | Prep. Ex. 2 | 900 | 60 | 5 | 800 | 350 | 120 | 200 | 240 |
| Comp. Ex. 3 | Prep. Ex. 2 | 900 | 60 | 5 | 800 | 150 | 65 | 200 | 240 |
| Comp. Ex. 4 | Prep. Ex. 2 | 890 | 60 | 5 | 700 | 600 | 300 | 200 | 240 |
| Comp. Ex. 5 | Prep. Ex. 6 | 890 | 60 | 5 | 800 | 600 | 300 | 200 | 240 |
| Comp. Ex. 6 | Prep. Ex. 7 | 900 | 60 | 5 | 800 | 600 | 300 | 200 | 240 |
| Comp. Ex. 7 | Prep. Ex. 8 | 900 | 60 | 5 | 800 | 600 | 300 | 200 | 240 |
| Comp. Ex. 8 | Prep. Ex. 9 | 900 | 60 | 5 | 800 | 480 | 150 | 200 | 240 |
| Comp. Ex. 9 | Prep. Ex. 10 | 900 | 60 | 5 | 800 | 600 | 300 | 200 | 240 |

For the cold-rolled steel sheets of Examples 1 to 15 and Comparative Examples 1 to 9, a tensile test and a 900 bending test were performed, and for the cold-rolled steel sheets of Examples 1, 4, 8, 14 and 15 and Comparative Examples 6, 7 and 9, representative of the Examples and the Comparative Examples, a delayed fracture tests were performed. The results of the test are shown in Table 3 below. The delayed fracture tests were performed according to ASTM G39-99 standard (4-point load test). In the delayed fracture test, the stress applied as a test condition was 100% of the YS of each specimen, and a 0.1 M HCl solution was used as a corrosion solution.

TABLE 3

| | YS (MPa) | TS (MPa) | EI (%) | YR | 90° bending work-ability (R/t) | Hydrogen delayed fracture test (after 100 hours) | Pass |
|---|---|---|---|---|---|---|---|
| Ex. 1 | 1,335 | 1,475 | 6.7 | 90.5 | 0.50 | Not fractured | ○ |
| Ex. 2 | 1,290 | 1,571 | 6.1 | 82.1 | 0.67 | — | ○ |
| Ex. 3 | 1,297 | 1,578 | 5.4 | 82.2 | 0.67 | — | ○ |
| Ex. 4 | 1,342 | 1,526 | 6.4 | 88.0 | 0.50 | Not fractured | ○ |
| Ex. 5 | 1,313 | 1,535 | 6.2 | 85.5 | 0.67 | — | ○ |
| Ex. 6 | 1,233 | 1,485 | 6.5 | 83.0 | 0.33 | — | ○ |
| Ex. 7 | 1,232 | 1,475 | 7.1 | 83.5 | 0.50 | — | ○ |
| Ex. 8 | 1,308 | 1,602 | 5.8 | 81.7 | 0.50 | Not fractured | ○ |
| Ex. 9 | 1,301 | 1,661 | 7.6 | 78.3 | 0.67 | — | ○ |
| Ex. 10 | 1,341 | 1,603 | 6.7 | 83.7 | 0.33 | — | ○ |
| Ex. 11 | 1,359 | 1,558 | 5.6 | 87.2 | 0.50 | — | ○ |
| Ex. 12 | 1,334 | 1,640 | 6.9 | 81.3 | 0.50 | — | ○ |
| Ex. 13 | 1,333 | 1,623 | 6.4 | 82.2 | 0.67 | Not fractured | ○ |
| Ex. 14 | 1,276 | 1,535 | 6 | 83.1 | 0.33 | Not fractured | ○ |
| Ex. 15 | 1,285 | 1,543 | 5.8 | 83.3 | 0.33 | — | ○ |
| Comp. Ex. 1 | 1,146 | 1,593 | 5.4 | 71.9 | 1.67 | — | X |
| Comp. Ex. 2 | 1,183 | 1,437 | 7.2 | 82.3 | 0.33 | — | X |
| Comp. Ex. 3 | 1,124 | 1,389 | 6.3 | 80.9 | 0.33 | — | X |
| Comp. Ex. 4 | 1,202 | 1,428 | 4.1 | 84.2 | 0.50 | — | X |
| Comp. Ex. 5 | 1,250 | 1,441 | 4.8 | 86.7 | 0.33 | — | X |
| Comp. Ex. 6 | 1,349 | 1,496 | 6.8 | 90.2 | 0.50 | Fractured | X |
| Comp. Ex. 7 | 1,460 | 1,711 | 5.1 | 85.3 | 1.17 | Fractured | X |
| Comp. Ex. 8 | 1,032 | 1,350 | 5.4 | 76.4 | 0.83 | — | X |
| Comp. Ex. 9 | 1,392 | 1,675 | 5.1 | 84.3 | 1.83 | Fractured | X |

Referring to the results in Table 3, it could be seen that Examples 1 to 15 satisfied the mechanical strengths (yield strength (YS): 1,200 MPa or greater, tensile strength (TS): 1,470 MPa or greater, and elongation (EL): 500 or greater) and bending workability (1.5 or less) targeted by the present invention, and the specimens of Examples 1, 4, 8, 14 and 15 did not fracture even after 100 hours or more during the hydrogen delayed fracture test, suggesting that they have excellent hydrogen delayed fracture resistance.

On the other hand, in the case of Comparative Example 1 to which the tempering process of the present invention was not applied, the yield strength and bending workability targeted by the present invention were not achieved, and in the case of Comparative Examples 2 and 3 in which the cooling rate in the cooling zone (2) during second cooling was less than 140° C./sec, the yield strength and tensile strength were less than the target values of the present invention. In the case of Comparative Example 4 in which first cooling was terminated at a temperature lower than 730° C., the tensile strength did not satisfy the target value, and in the case of Comparative Example 5 in which the content of carbon among the alloying components was low, the target values were not satisfied. In the case of Comparative Example 6 in which the manganese (Mn) content exceeded the target value and in the case of Comparative Example 7 in which the boron (B) content was below the target value, fracture occurred in the delayed fracture test. It could be seen that, in the case of Comparative Example 8 in which the manganese (Mn) content was insufficient, the yield strength and the tensile strength were below the target values. It could be seen that, in the case of Comparative Example 9 in which the mass ratio (Nb/Ti) of niobium to titanium exceeded 1.5, the bending workability exceeded 1.5, and thus the specimen fractured in the hydrogen delayed fracture test.

Meanwhile, in order to confirm the phase transformation depending on the difference in the cooling rate, the specimen of Preparation Example 2 was heated to 900° C., annealed and then continuously cooled at a rate of each of 50° C./sec and 100° C./sec. The resulting microstructures are shown in FIG. 3.

Figure 3A:
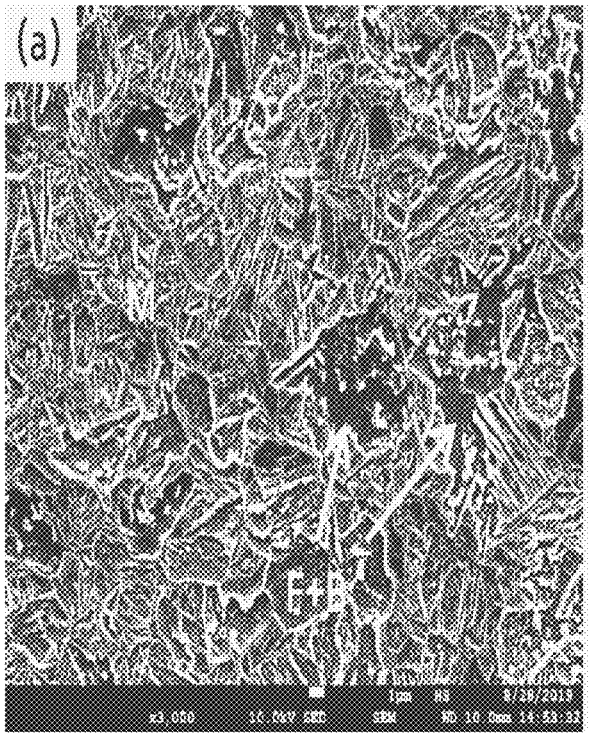
FIG. 3A shows the microstructure of a cold-rolled steel sheet manufactured using a second cooling rate deviating from the second cooling rate of the present invention.
Figure 3B:
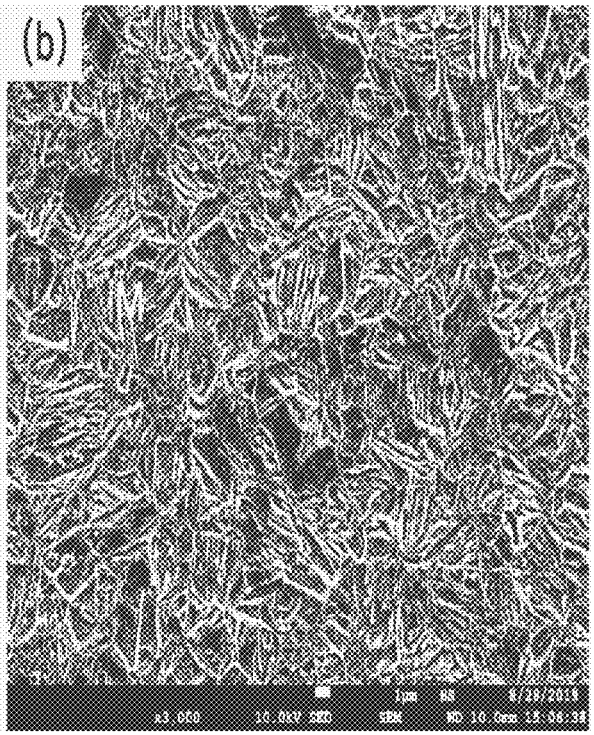
FIG. 3B shows the microstructure of a cold-rolled steel sheet manufactured using the second cooling rate of the present invention.

FIG. 3A is a photograph showing the microstructure of the cold-rolled steel sheet subjected to second cooling at a cooling rate of 50° C./s, and FIG. 3B is a photograph showing the microstructure of the cold-rolled steel sheet subjected to second cooling at a cooling rate of 100° C./s. Referring to FIG. 3, it could be seen that ferrite and bainite regions were observed in the cold-rolled steel sheet of FIG. 3A to which the second cooling rate of the present invention was not applied, but a martensitic single-phase structure was formed in the cold-rolled steel sheet of FIG. 3B, to which the second cooling rate of the present invention was applied.

Figure 4A:
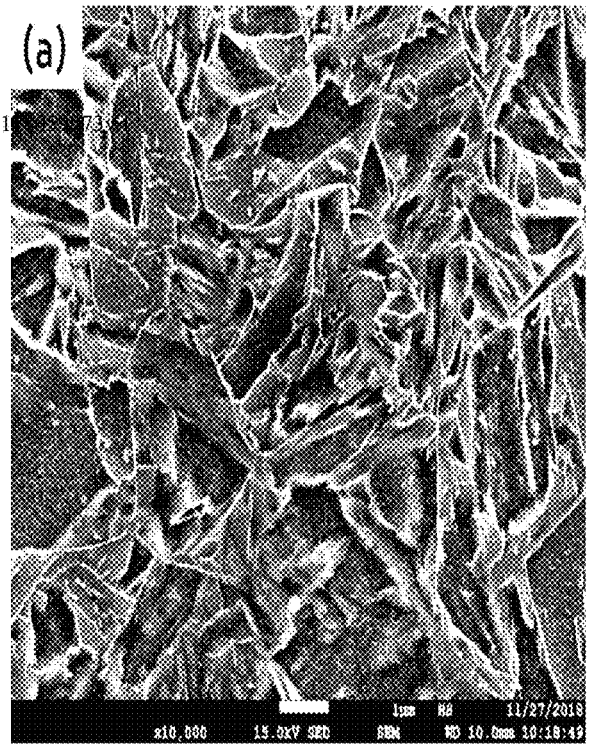
FIG. 4A shows the microstructure of a cold-rolled steel sheet of Example 1.
Figure 4B:
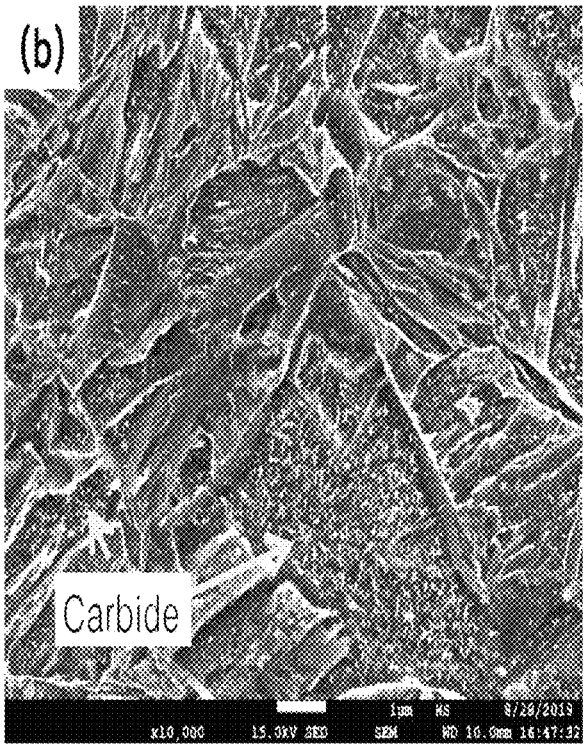
FIG. 4B shows the microstructure of a cold-rolled steel sheet of Comparative Example 3.

FIG. 4A shows the microstructure of the cold-rolled steel sheet of Example 1, and FIG. 4(*b*) shows the microstructure of the cold-rolled steel sheet of Comparative Example 3. Referring to FIG. 4, it could be confirmed that the microstructure of Example 1, cooled in the cooling zone (2) at a cooling rate of 300° C./s after cooling in the cooling zone (1) at a rate of 80° C./s or greater during second cooling, had an average grain size of 6 μm or less as shown in FIG. 4A, and thus it was difficult to observe carbides in the tempered martensite structure, but in the case of the microstructure of Comparative Example 3 cooled in the cooling section (2) at a cooling rate of 65° C./s, tempering occurred during cooling such that carbides in martensite could be easily observed as shown in FIG. 4B.

In addition, it could be seen that the specimen of Example 1 of the present invention did not fracture even after 100 hours during the hydrogen delayed fracture test, and thus had excellent hydrogen delayed fracture resistance, but the specimen of Comparative Example 6 did fracture, and thus had poor hydrogen delayed fracture resistance.

Accordingly, it can be seen that, when the cooling rate conditions of the present invention are applied, it is possible to suppress the transformation of ferrite and bainite during cooling, and to suppress even tempering during cooling of martensite, and to secure a tempered martensite structure, in which it is impossible to observe carbides, by tempering.

Simple modifications or changes of the present invention can be easily implemented by those skilled in the art, and these modifications or changes can be considered included within the scope of the present invention.

The invention claimed is:

1. A cold-rolled steel sheet comprising: an amount of 0.10 to 0.40 wt % carbon (C), an amount of 0.10 to 0.80 wt % silicon (Si), an amount of 0.6 to 1.4 wt % manganese (Mn), an amount of 0.01 to 0.30 wt % aluminum (Al), an amount greater than 0 and less than or equal to 0.02 wt % phosphorus (P), an amount greater than 0 and less than or equal to 0.003 wt % sulfur (S), an amount greater than 0 and less than or equal to 0.006 wt % nitrogen (N), an amount greater than 0 and less than or equal to 0.05 wt % titanium (Ti), an amount of 0 to 0.05 wt % niobium (Nb), an amount of 0.001 to 0.003 wt % boron (B), and the remainder being iron (Fe) and other inevitable impurities, and wherein the steel sheet has a microstructure comprising tempered martensite, and has a 90° bending workability (R/t; a ratio of the 90° bending radius (R) to the sheet thickness (t)) of 1.5 or less, and a mass ratio (Nb/Ti) of niobium (Nb) to titanium (Ti) of 1.5 or less;

wherein the microstructure has an average grain size of 6 μm or less, wherein the microstructure contains at least one of titanium-based precipitates and niobium-based precipitates, wherein the ratio of precipitates each having a size of 100 nm or less among the precipitates present in the unit area (1 $\mu m^2$=1 μm×1 μm) at any point of the cold-rolled steel sheet to precipitates each having a size of more than 100 nm among the precipitates is 4:1 or greater, and wherein a yield strength (YS) of 1,200 MPa or greater, a tensile strength (TS) of 1,470 MPa or greater, and an elongation (EL) of 5.0% or greater.

2. The cold-rolled steel sheet of claim 1, further comprising an amount greater than 0 and less than or equal to 0.2 wt % molybdenum (Mo).

3. The cold-rolled steel sheet of claim 1, which does not fracture for 100 hours or more during a hydrogen delayed fracture test (4-point load test) performed according to ASTM G39-99 standard.

4. A method for manufacturing a cold-rolled steel sheet according to claim 1, the method comprising steps of:

manufacturing a hot-rolled steel sheet from a steel slab comprising an amount of 0.10 to 0.40 wt % carbon (C), an amount of 0.10 to 0.80 wt % silicon (Si), an amount of 0.6 to 1.4 wt % manganese (Mn), an amount of 0.01 to 0.30 wt % aluminum (Al), an amount greater than 0 and less than or equal to 0.02 wt % phosphorus (P), an amount greater than 0 and less than or equal to 0.003 wt % sulfur (S), an amount greater than 0 and less than or equal to 0.006 wt % nitrogen (N), an amount greater than 0 and less than or equal to 0.05 wt % titanium (Ti), an amount of 0 to 0.05 wt % niobium (Nb), 0.001 to 0.003 wt % boron (B), and the remainder being iron (Fe) and other inevitable impurities;

manufacturing a cold-rolled steel sheet by cold rolling the hot-rolled steel sheet;

subjecting the cold-rolled steel sheet to an annealing heat treatment by heating to and holding at a temperature higher than or equal to $Ae_3$ temperature;

cooling the cold-rolled steel sheet subjected to the annealing heat treatment; and tempering the cooled cold-rolled steel sheet, wherein the cooling comprises: a first cooling step of cooling the cold-rolled steel sheet, subjected to annealing heat treatment, to a temperature of 730 to 820° C. at a cooling rate of 15° C./s or less; and a second cooling step of cooling the cold-rolled steel sheet, subjected to the first cooling step, to a temperature of room temperature to 150° C. at a cooling rate of 80° C./s or greater, and the manufactured cold-rolled steel sheet has a microstructure comprising tempered martensite.

5. The method of claim 4, wherein the steel slab further includes an amount greater than 0 and less than or equal to 0.2 wt % molybdenum (Mo).

6. The method of claim 4, wherein the hot-rolled steel sheet is manufactured by a method comprising steps of:

reheating the steel slab to a temperature of 1,180 to 1,250° C.;

manufacturing a rolled material by hot-rolling the reheated steel slab at a finish delivery temperature of 850 to 950° C.; and cooling the rolled material, followed by coiling at a coiling temperature of 450 to 650° C.

7. The method of claim 4, wherein the cooling rate from 450° C. to 150° C. in the second cooling step is 140° C./s or greater.

8. The method of claim 4, wherein the tempering is performed by heating the cold-rolled steel sheet to a temperature of 150 to 250° C., followed by holding for 50 to 500 seconds.

9. The method of claim 4, wherein the cold-rolled steel sheet does not fracture for 100 hours or more during a hydrogen delayed fracture test (4-point load test) performed according to ASTM G39-99 standard.

* * * * *